US011006814B1

(12) United States Patent
Simmonds

(10) Patent No.: US 11,006,814 B1
(45) Date of Patent: May 18, 2021

(54) STEMWARE SUPPORT/CUP SHELF FOR DISHWASHER

(71) Applicants: BSH Home Appliances Corporation, Irvine, CA (US); BSH Hausgeräte GmbH, Munich (DE)

(72) Inventor: Edward Simmonds, New Bern, NC (US)

(73) Assignees: BSH Home Appliances Corporation, Irvine, CA (US); BSH Hausgeräte GmbH, Munich (DE)

( * ) Notice: Subject to any disclaimer, the term of this patent is extended or adjusted under 35 U.S.C. 154(b) by 0 days.

(21) Appl. No.: 16/892,331

(22) Filed: Jun. 4, 2020

(51) Int. Cl.
*A47L 15/50* (2006.01)

(52) U.S. Cl.
CPC ..... *A47L 15/505* (2013.01); *A47L 15/502* (2013.01); *A47L 15/503* (2013.01)

(58) Field of Classification Search
CPC .... A47L 15/505; A47L 15/502; A47L 15/503; A47L 15/50; A47L 15/506; A47L 15/507; A47L 19/04
USPC ..... 211/41.9, 41.8, 41.6; 220/487, 488; 134/134; D32/3
See application file for complete search history.

(56) References Cited

U.S. PATENT DOCUMENTS 3,752,322 A * 8/1973 Fiocca ..... A47L 15/505 211/41.8
3,934,728 A * 1/1976 Guth ..... A47L 15/503 211/41.9
4,589,556 A * 5/1986 Peretz ..... A47L 15/505 211/41.2
4,917,248 A * 4/1990 Friskney ..... A47L 15/503 211/184
5,287,984 A * 2/1994 Michael ..... A47L 15/502 220/555
5,480,035 A * 1/1996 Smith ..... A47L 15/503 211/168
6,109,455 A * 8/2000 Schroeder ..... A47L 15/505 211/41.9
6,325,220 B1 * 12/2001 Malmstrom ..... A47L 15/503 211/41.1
6,394,285 B1 5/2002 Arthurs et al.
D516,757 S * 3/2006 Hedstrom ..... A47L 15/503 D32/2
D518,936 S * 4/2006 Yang ..... D32/55
7,644,826 B2 * 1/2010 Koch ..... A47L 15/503 211/41.4

(Continued)

FOREIGN PATENT DOCUMENTS

DE 102014207448 B4 4/2017

*Primary Examiner* — Jennifer E. Novosad
(74) *Attorney, Agent, or Firm* — Michael E. Tschupp; Andre Pallapies; Brandon G. Braun

(57) ABSTRACT

A stemware support/cup shelf assembly disposed on a washware rack for supporting stemware and which also serves as a cup shelf, including: a frame having a front edge portion with a plurality of notches which support stemware, an upper shelf portion which serves as a cup shelf, and a rear edge portion having a pair of mounts for mounting the stemware support/cup shelf assembly to a side wall portion of the washware rack. Each of the pair of mounts is configured to allow the frame to rotate upward from a stowed position into a working angle position and then slide horizontally into a final locked position.

17 Claims, 11 Drawing Sheets

(56) References Cited

U.S. PATENT DOCUMENTS 7,665,475 B2 * 2/2010 Hedstrom ..... A47L 15/503 134/134
7,690,517 B2 4/2010 Purushothaman et al.
7,766,175 B2 * 8/2010 Jadhav ..... A47L 15/505 211/41.9
D640,842 S * 6/2011 Eng ..... D32/3
8,042,559 B2 * 10/2011 Choi ..... B08B 3/04 134/137
8,167,147 B2 * 5/2012 Frankel ..... A47L 19/04 211/41.3
8,567,882 B1 * 10/2013 Garnett ..... A47L 15/504 312/228.1
8,701,898 B2 * 4/2014 Chai ..... A47L 15/504 211/41.6
8,757,419 B2 * 6/2014 Schessl ..... A47L 15/505 220/489
8,789,711 B2 * 7/2014 Haltmayer ..... A47L 15/504 211/41.9
9,033,432 B2 * 5/2015 Kilic ..... A47L 15/503 312/228.1
D732,754 S * 6/2015 Roberson ..... D32/3
9,119,524 B2 9/2015 Renz et al.
9,131,828 B2 * 9/2015 Yoon ..... A47L 15/503
D774,712 S * 12/2016 Seo ..... D32/3
9,615,722 B2 * 4/2017 Mesa ..... A47L 15/50
D796,750 S 9/2017 Hederstierna et al.
9,877,632 B2 1/2018 Roberson et al.
9,901,240 B2 * 2/2018 Lee ..... A47L 15/503
10,052,012 B2 * 8/2018 Mesa ..... A47L 15/505
10,159,397 B2 * 12/2018 Citak ..... A47L 15/505
10,165,927 B2 * 1/2019 Mesa ..... A47L 15/505
10,463,226 B2 11/2019 Mesa et al.
10,743,742 B2 * 8/2020 Buesing ..... A47L 15/28
2002/0148494 A1 * 10/2002 Smith ..... A47L 15/505 134/201
2004/0108283 A1 * 6/2004 Miilu ..... A47L 15/505 211/41.9
2005/0242046 A1 * 11/2005 Lee ..... A47L 15/503 211/41.9
2006/0108298 A1 * 5/2006 Kim ..... A47L 15/503 211/41.8
2006/0113260 A1 * 6/2006 Purushothaman .... A47L 15/505 211/41.8
2007/0039904 A1 * 2/2007 Purushothaman .... A47L 15/504 211/41.8
2007/0039905 A1 * 2/2007 Purushothaman .... A47L 15/505 211/41.8
2008/0110480 A1 * 5/2008 Choi ..... A47L 15/503 134/135
2008/0185352 A1 8/2008 O'Hara
2010/0300997 A1 * 12/2010 Bramley ..... A47L 15/505 211/74
2011/0018410 A1 * 1/2011 Bastuji ..... A47L 15/504 312/228.1
2011/0192808 A1 * 8/2011 Buhl ..... A47L 15/505 211/41.9
2011/0253650 A1 * 10/2011 Renz ..... A47L 15/503 211/41.9
2012/0062085 A1 * 3/2012 Bastuji ..... A47L 15/502 312/228.1
2012/0292273 A1 * 11/2012 Mcnamara ..... A47L 15/503 211/79
2012/0298598 A1 * 11/2012 Ennen ..... A47L 15/503 211/41.8
2014/0021149 A1 * 1/2014 Eng ..... A47L 15/505 211/41.8
2017/0254472 A1 * 9/2017 Forsberg ..... F16B 2/22
2017/0258294 A1 9/2017 Mesa et al.
2018/0146837 A1 * 5/2018 Mesa ..... A47L 15/505
2019/0069756 A1 * 3/2019 Harr ..... A47L 15/505
2019/0290098 A1 * 9/2019 Mohite ..... A47L 15/505
2020/0281441 A1 * 9/2020 Kim ..... A47L 15/503

* cited by examiner

STEMWARE SUPPORT/CUP SHELF FOR DISHWASHER

FIELD OF THE INVENTION

The present disclosure relates generally to dishwasher appliances and to racks for holding dishware and glassware for a dishwasher. More particularly, the present disclosure relates to a stemware support/cup shelf disposed on a washware rack for stemware such as wine glasses, and which also serves as a cup shelf for cups and other small items.

BACKGROUND OF THE INVENTION

In general, most domestic dishwashers include two washware or dishware racks to support items to be washed such as dishware, glassware, kitchen utensils, pots, pans, and the like. Typically, the two washware racks include an upper washware rack positioned near a top portion of the dishwasher, and a lower washware rack arranged below the upper washware rack. The upper washware rack is used to support glassware, utensils, and other small items, while the lower washware rack is used to support larger items, such as dinner plates, large bowls, cooking sheets, and baking pans. Some dishwashers also include a third, top washware rack arranged immediately above a second or middle washware rack and for holding smaller items such as utensils, cups, and small bowls. The second, middle washware rack is in turn positioned above a first, bottom or lower washware rack inside the dishwashing compartment. The washware racks are normally formed from several discrete lengths of wire, welded together and then covered with a rubber or a plastic coating. Further, the various washware racks are typically formed with a plurality of vertically projecting, fixed tines and/or fixed ribs to support and organize the items placed on the washware rack.

Some dishwashers have devices for supporting the stems of wine glasses when the wine glasses are placed in a washware rack and which can also be used to support cups on an upper shelf area. Such devices may also have hinge mechanisms to allow them to be rotated upward when not in use to free up space in the washware rack.

SUMMARY OF THE INVENTION

However, the above-described devices for supporting the stems of wine glasses have complicated hinge mechanisms that are difficult for a user to operate and are also costly to manufacture. Also, the complicated hinge mechanisms are more liable to break or malfunction with continued use.

An apparatus consistent with the present disclosure is directed to providing a stemware support/cup shelf assembly disposed on a washware rack of a dishwasher that is not only versatile, but is also easy for the user to operate and inexpensive to manufacture.

According to one aspect, the present disclosure provides a stemware support/cup shelf assembly disposed on a washware rack for supporting stemware and which also serves as a cup shelf, comprising: a frame having a front edge portion with a plurality of notches which support stemware, an upper shelf portion which serves as a cup shelf, and a rear edge portion having a pair of mounts for mounting the stemware support/cup shelf assembly to a side wall portion of the washware rack, wherein each of the pair of mounts is configured to allow the frame to rotate upward from a stowed position into a working angle position and then slide horizontally into a final locked position.

According to another aspect, each of the pair of mounts comprises a vertical slot and a horizontal slot which interact with a corresponding vertical wire of the side wall portion of the washware rack.

According to another aspect, the horizontal slot includes a retaining nub which clicks past the corresponding vertical wire of the side wall portion of the washware rack on condition that the frame of the stemware support/cup shelf assembly is slid into the final locked position.

According to another aspect, the frame comprises hinges which allow the frame to rotate downward into the stowed position along the side wall portion of the washware rack.

According to another aspect, the frame is supported by the hinges when in the stowed position along the side wall portion of the washware rack.

According to another aspect, the hinges are disposed along the rear edge portion next to the pair of mounts, the hinges allowing the frame to rotate about a horizontal wire of the side wall portion of the washware rack.

According to another aspect, the present disclosure provides a washware rack of a dishwasher, comprising: a basket formed by a plurality of wire shaped elements, the plurality of wire shaped elements including a bottom portion and a side wall portion; and at least one stemware support/cup shelf assembly disposed on the side wall portion of the basket for supporting stemware and which also serves as a cup shelf, the at least one stemware support/cup shelf assembly including a frame having a front edge portion with a plurality of notches which support stemware, an upper shelf portion which serves as a cup shelf, and a rear edge portion having a pair of mounts for mounting the at least one stemware support/cup shelf assembly to the side wall portion of the basket, wherein each of the pair of mounts is configured to allow the frame to rotate upward from a stowed position into a working angle position and then slide into a final locked position.

According to another aspect, each of the pair of mounts comprises a vertical slot and a horizontal slot which interact with a corresponding vertical wire of the side wall portion of the basket.

According to another aspect, the horizontal slot includes a retaining nub which clicks past the corresponding vertical wire of the side wall portion of the basket on condition that the frame of the at least one stemware support/cup shelf assembly is slid into the final locked position.

According to another aspect, the frame comprises hinges which allow the frame to rotate downward into the stowed position along the side wall portion of the basket.

According to another aspect, the frame is supported by the hinges when in the stowed position along the side wall portion of the basket.

According to another aspect, the washware rack further comprises another of the at least one stemware support/cup shelf assembly such that there is a pair of stemware support/cup shelf assemblies disposed on the side wall portion of the basket, with each one of the pair of stemware support/cup shelf assemblies having three notches configured to support a like number of stemware.

According to another aspect, the hinges are disposed along the rear edge portion next to the pair of mounts, the hinges allowing the frame to rotate about a horizontal wire of the plurality of wire shaped elements of the side wall portion of the washware rack.

According to another aspect, the present disclosure provides a dishwasher, comprising: a dishwashing compartment having a loading opening; a door configured to close the loading opening; at least one washware rack configured as a basket formed by a plurality of wire shaped elements, the plurality of wire shaped elements including a bottom portion and a side wall portion and being configured for movement out of and into the dishwashing compartment; and at least one stemware support/cup shelf assembly disposed on the side wall portion of the basket for supporting stemware and which also serves as a cup shelf, the at least one stemware support/cup shelf assembly including a frame having a front edge portion with a plurality of notches which support stemware, an upper shelf portion which serves as a cup shelf, and a rear edge portion having a pair of mounts for mounting the at least one stemware support/cup shelf assembly to the side wall portion of the basket, wherein each of the pair of mounts is configured to allow the frame to rotate upward from a stowed position into a working angle position and then slide into a final locked position.

According to another aspect, each of the pair of mounts comprises a vertical slot and a horizontal slot which interact with a corresponding vertical wire of the side wall portion of the basket.

According to another aspect, the horizontal slot includes a retaining nub which clicks past the corresponding vertical wire of the side wall portion of the basket on condition that the frame of the at least one stemware support/cup shelf assembly is slid into the final locked position.

According to another aspect, the frame comprises hinges which allow the frame to rotate downward into the stowed position along the side wall portion of the basket.

According to another aspect, the frame is supported by the hinges when in the stowed position along the side wall portion of the basket.

According to another aspect, the dishwasher further comprises another of the at least one stemware support/cup shelf assembly such that there is a pair of stemware support/cup shelf assemblies disposed on the side wall portion of the basket, with each one of the pair of stemware support/cup shelf assemblies having three notches configured to support a like number of stemware.

According to another aspect, the hinges are disposed along the rear edge portion next to the pair of mounts, the hinges allowing the frame to rotate about a horizontal wire of the plurality of wire shaped elements of the side wall portion of the washware rack.

BRIEF DESCRIPTION OF THE DRAWING FIGURES

The accompanying drawing figures incorporated in and forming a part of this specification illustrate several aspects of the invention, and together with the description serve to explain the principles of the invention.

Figure 8:
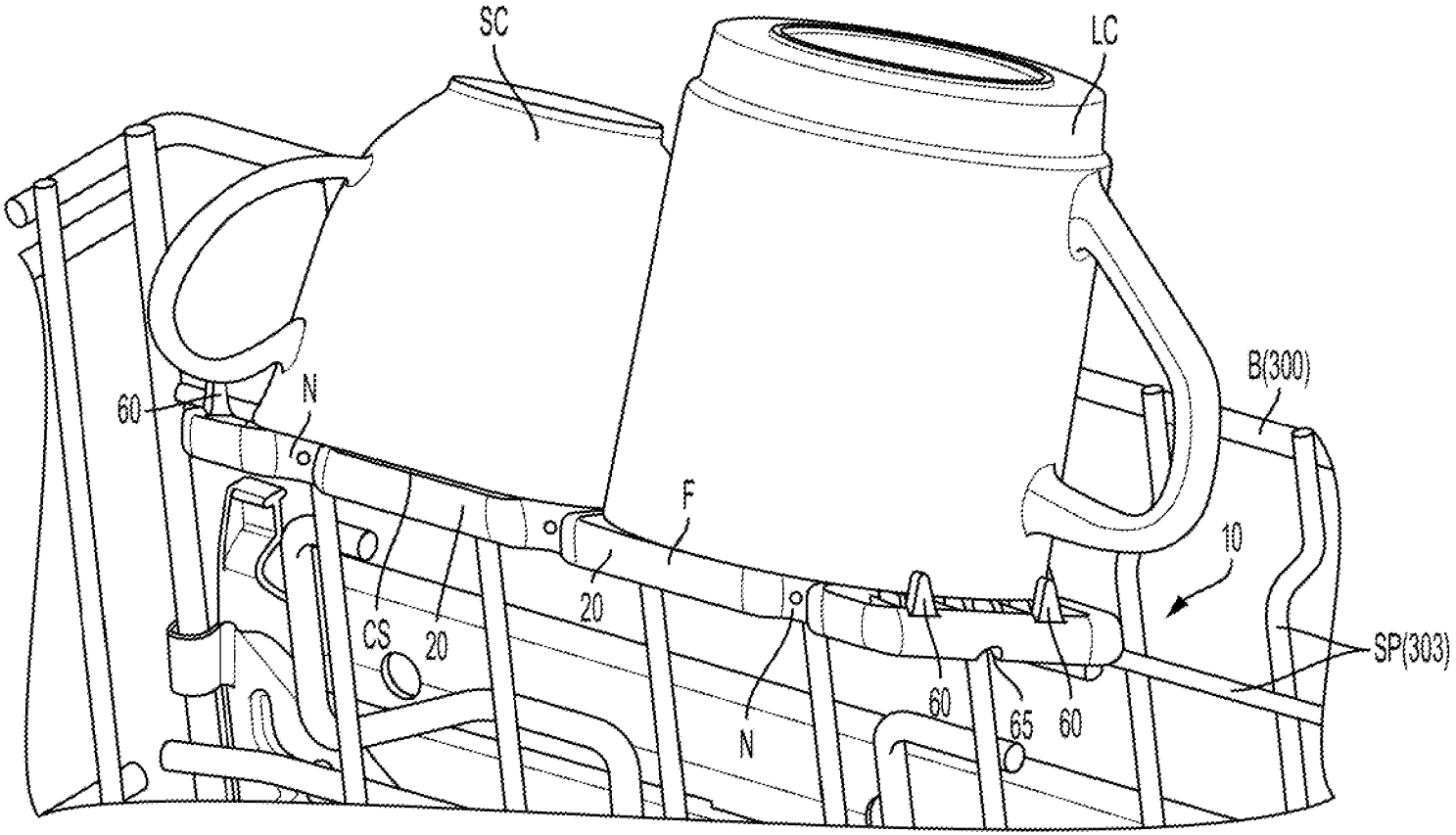
Figure 9:
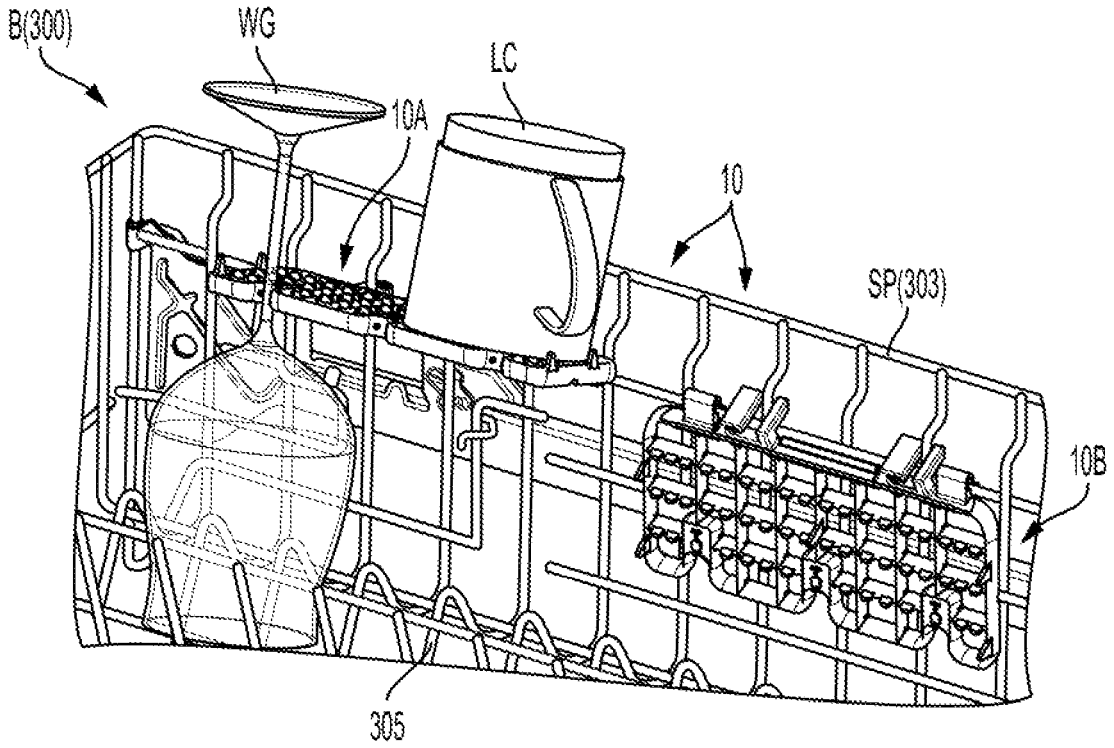

FIG. 8 is a perspective view of the stemware support/cup shelf assembly shown supporting two cups on the upper shelf portion according to an exemplary embodiment consistent with the present disclosure; and FIG. 9 is a fragmentary perspective view of a washware rack with a pair of the stemware support/cup shelf assemblies, with one supporting a stemmed wine glass and a cup and the other being in a stowed position according to an exemplary embodiment consistent with the present disclosure.

DETAILED DESCRIPTION OF THE EXEMPLARY EMBODIMENTS

The exemplary embodiments set forth below represent the necessary information to enable those skilled in the art to practice the invention. Upon reading the following description in light of the accompanying drawing figures, those skilled in the art will understand the concepts of the invention and will recognize applications of these concepts not particularly addressed herein. It should be understood that these concepts and applications fall within the scope of the disclosure and the accompanying claims.

Moreover, it should be understood that terms such as top, bottom, front, rear, middle, upper, lower, right side, left side, vertical, horizontal, downward, upward, and the like used herein are for orientation purposes with respect to the drawings when describing the exemplary embodiments and should not limit the present invention unless explicitly indicated otherwise in the claims. Also, terms such as substantially, approximately, and about are intended to allow for variances to account for manufacturing tolerances, measurement tolerances, or variations from ideal values that would be accepted by those skilled in the art.

Figure 1:
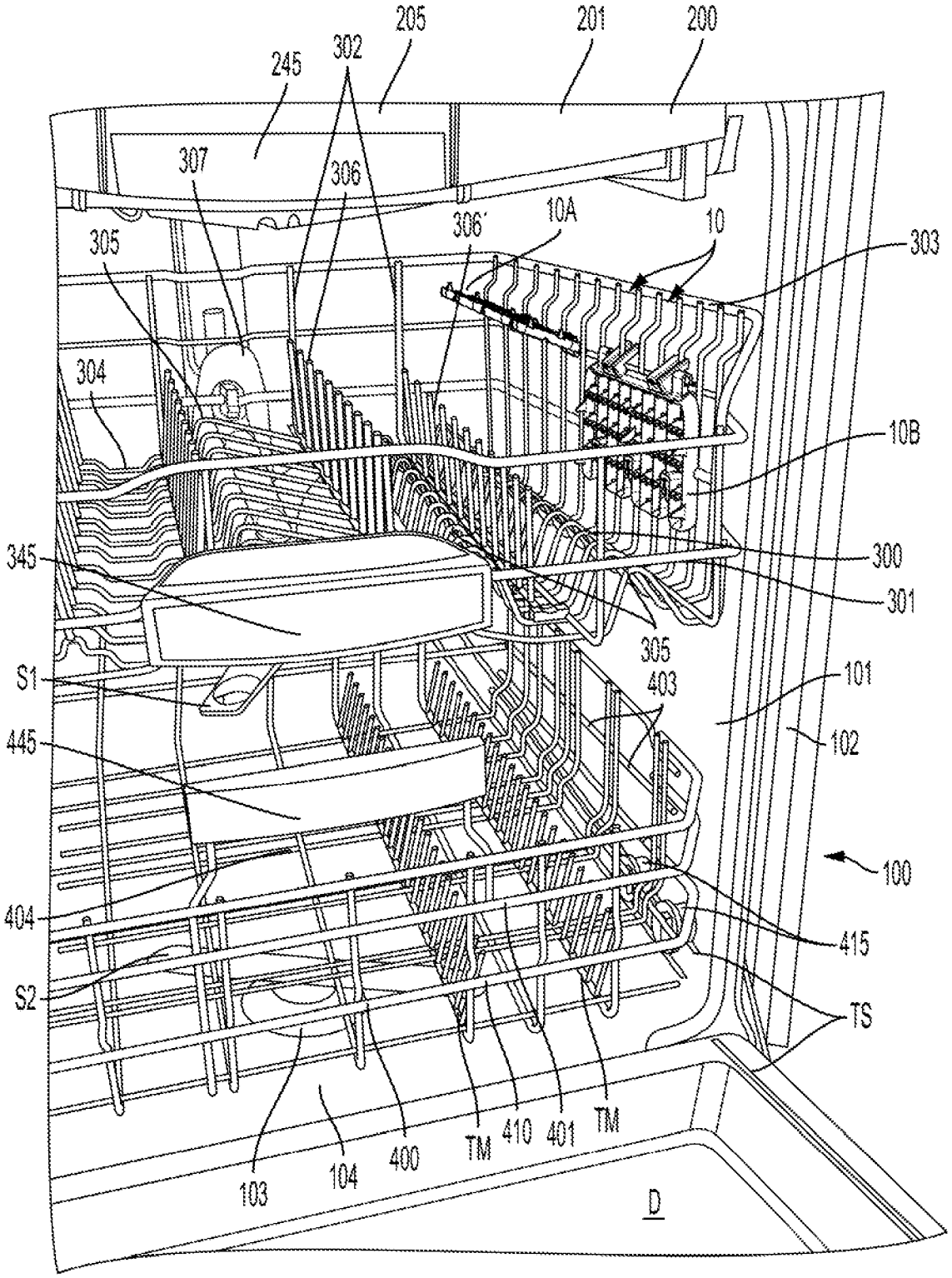
FIG. 1 is a front, fragmentary perspective view of a dishwasher appliance with the door open so as to reveal the dishwashing compartment including a washware rack that is configured to accommodate a stemware support/cup shelf assembly according to an exemplary embodiment consistent with the present disclosure.

FIG. 1 is a front perspective view of a dishwasher appliance 100 according to an exemplary embodiment consistent with present disclosure, with the door D open so as to reveal the dishwashing compartment 101 having a loading opening 102 and including a third, top washware rack 200 that is positioned immediately above a second or middle washware rack 300. The middle washware rack 300 is in turn positioned above a first, bottom or lower washware rack 400. As will be described in detail below, the middle washware rack 300, for example, is provided with a pair of stemware support/cup shelf assemblies 10 (see also FIGS. 2-9) disposed on the side wall portion of the middle washware rack 300, including a rear stemware support/cup shelf assembly 10A and a front stemware support/cup shelf assembly 10B, according to an exemplary embodiment consistent with the present disclosure. Note that the reference numeral 10 is used hereinafter to denote the stemware support/cup shelf assembly in general which can refer to either one of the rear stemware support/cup shelf assembly 10A or the front stemware support/cup shelf assembly 10B separately, or can also refer to both of them together as a pair.

As shown in FIG. 1, the dishwasher appliance 100 may also include rotating sprayer arms S1 and S2, and a drain 103 in a tub 104. The door D may include a washing agent dispenser WAD (see FIG. 2). Also, although not shown, as is known in the art, the dishwasher appliance 100 includes a pump and filter assembly, a heating element, a drain hose, and can include additional spray devices. A detailed description of the suitable structure and operation of the dishwasher appliance 100 does not form part of the present disclosure, but can be found, for example, in U.S. Pat. Nos. 9,445,703 and 9,510,729 which are incorporated herein by reference.

More specifically, the first, bottom or lower washware rack 400 is configured as a basket for holding larger plates, large bowls, pans, cookware such as a cooking sheet, etc. The bottom or lower washware rack 400 is configured as a basket 410 that includes a sidewall portion including front 401, rear (not shown), and opposing side walls 403 (one of which is visible) interconnected with a bottom portion 404 and formed by a plurality of wire shaped elements. The bottom or lower washware rack 400 may include a plurality of vertically extending tines or tine members TM. At the bottom portion of the bottom or lower washware rack 400 at the left and right sides thereof, rollers 415 are provided and are configured to run on corresponding flanges or tracks TS on the inside wall of the dishwashing compartment 101 and also on an inside surface of the door D, as is conventional in the art. The bottom washware rack 400 can include a handle 445.

The second or middle washware rack 300 is positioned immediately above the bottom washware rack 400. The middle washware rack 300 is configured as a basket to hold medium sized dishes, bowls such as medium sized bowls, and glasses. The middle washware rack 300 includes front 301, rear 302, and opposing side walls 303 (one of which is visible) interconnected with a bottom portion 304 and formed by a plurality of wire shaped elements. The bottom portion 304 includes a plurality of forms 305 and adjustable tine rows 306, 306' for holding items in place on the middle washware rack 300. The middle washware rack 300 has water feed 307 for the spray arm S1 (see also FIG. 2). The middle washware rack 300 can include a handle 345. As noted above, the middle washware rack 300, for example, is provided with a pair of stemware support/cup shelf assemblies 10. In this case, as shown in FIG. 1, the rear stemware support/cup shelf assembly 10A is shown in a use or working position and the front stemware support/cup shelf assembly 10B is shown in a stowed position along one of the side walls 303 in order to free up space in the middle washware rack 300 for other types of dishware.

As noted above, the bottom washware rack 400 and the middle washware racks 300 are formed of wire shaped elements that are configured to have a basket shape. The wire shaped elements of the bottom and middle washware racks 400 and 300, respectively, may be formed of solid plastic, metal wire coated with plastic or rubber, or composite materials.

As shown in FIG. 1, the third, top washware rack 200 is configured to hold cutlery and washware which is larger than cutlery such as, but not limited to, small dishes, bowls, cups, as well as cooking utensils. The third, top washware rack 200 includes front 201, rear (not shown), and opposing side walls (not shown) and can be a combination of a wire frame covered with a plastic piece, or entirely out of plastic. The third, top washware rack 200 can also be formed by a plurality of wire shaped elements formed either entirely out of metal (such as stainless steel), or metal (such as carbon steel) dipped in, for example, a Nylon powder so that the wire is coated. The third, top washware rack 200 can include a form or recess 205 on the front wall 201 for mounting thereon a handle 245.

The stemware support/cup shelf assembly 10 will now be described with reference to FIGS. 2-9. While the stemware support/cup shelf assembly 10 is described below in connection with the middle washware rack 300, other washware racks, such as the lower washware rack 400 or upper washware rack 200 can also be configured to accommodate stemware support/cup shelf assemblies 10 consistent with the present disclosure.

Figure 2:
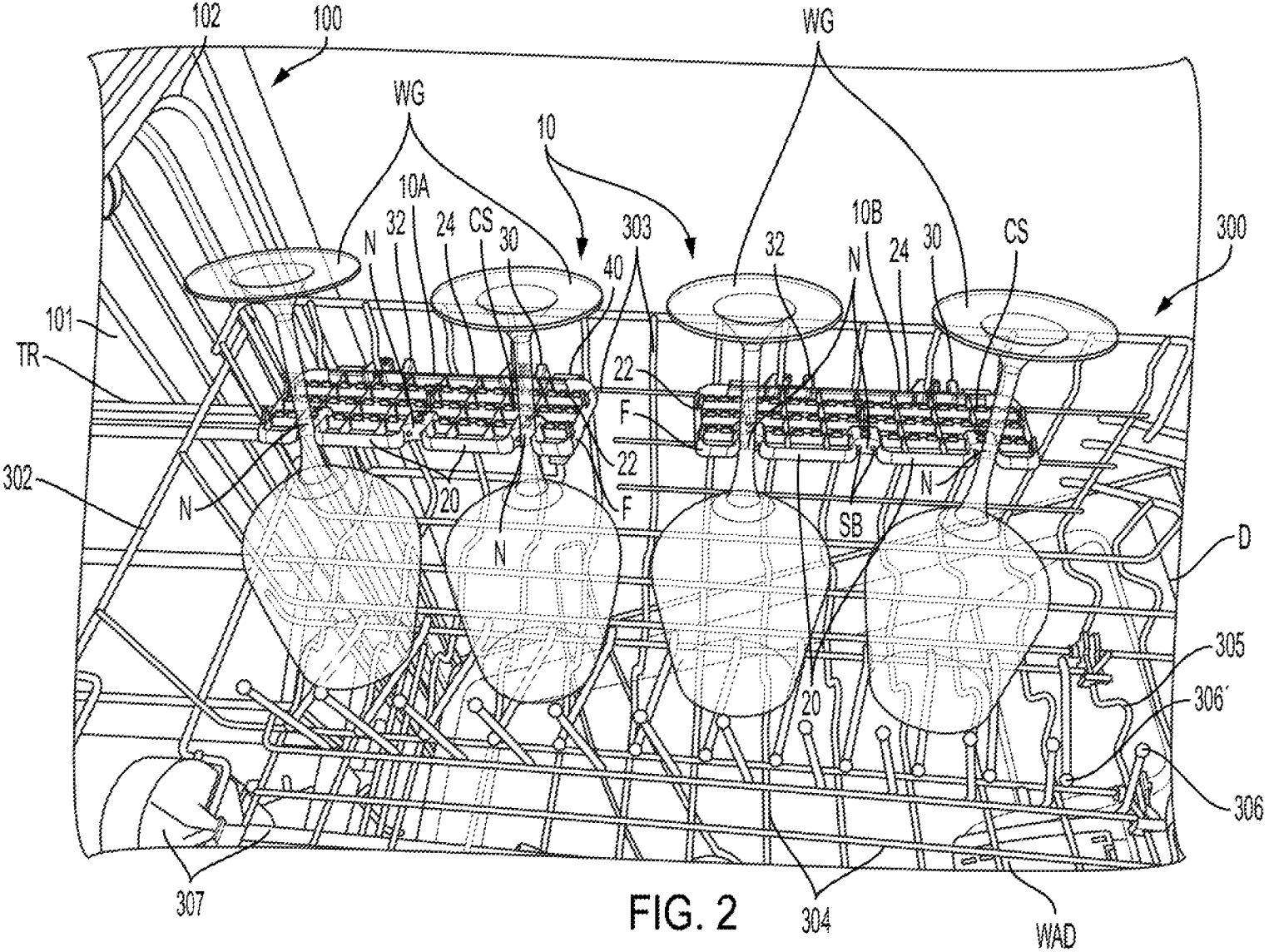
FIG. 2 is a fragmentary perspective view of a middle washware rack with a pair of the stemware support/cup shelf assemblies supporting four stemmed wine glasses according to an exemplary embodiment consistent with the present disclosure.
Figure 7:
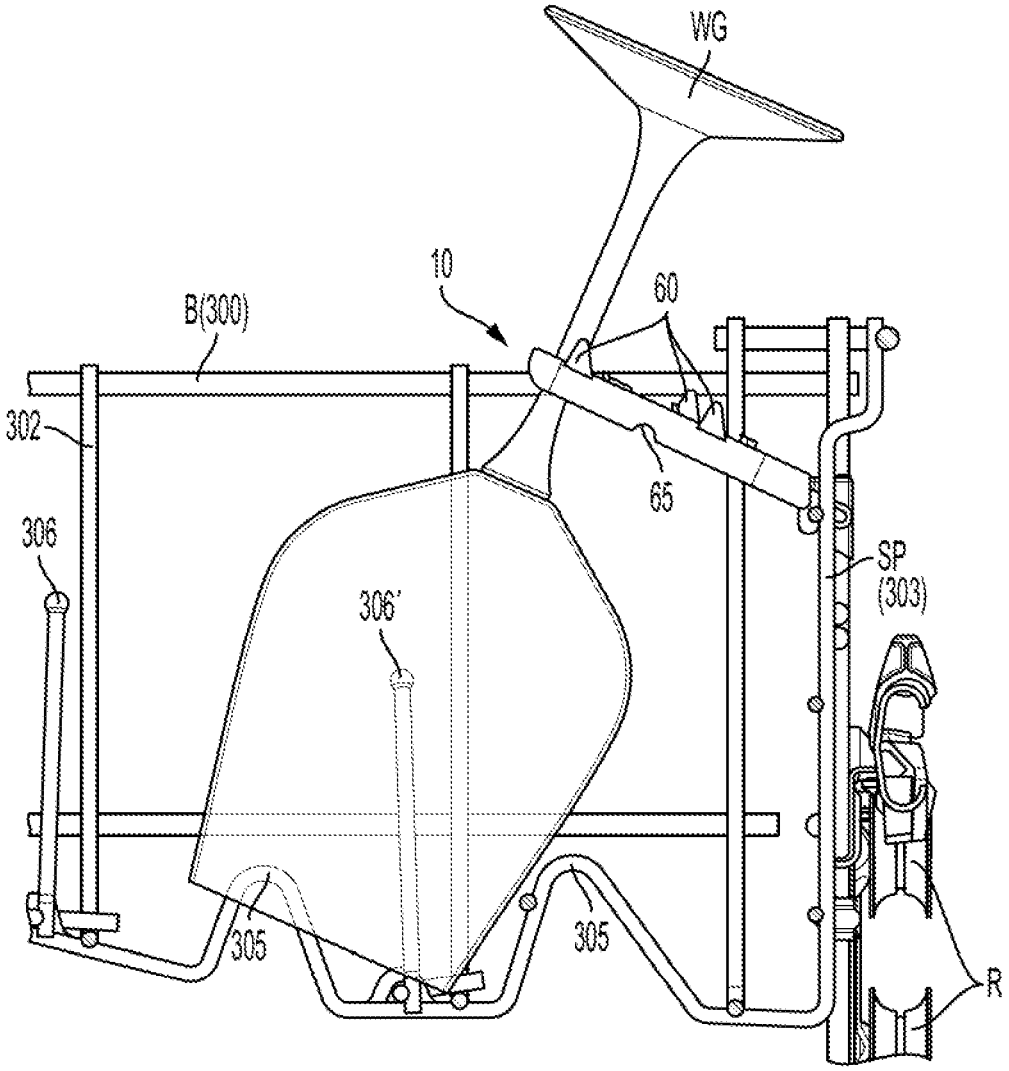
FIG. 7 is a partial sectional view through the washware rack and showing a side view of a wine glass supported by the stemware support/cup shelf assembly according to an exemplary embodiment consistent with the present disclosure.

FIG. 2 is a fragmentary perspective view of the middle washware rack 300 with a pair of the stemware support/cup shelf assemblies 10 supporting four stemmed wine glasses WG according to an exemplary embodiment consistent with the present disclosure. In this case, the rear stemware support/cup shelf assembly 10A and the front stemware support/cup shelf assembly 10B are both shown in the use position. The middle washware rack 300 may be mounted on telescopic rail assemblies TR (only one of which is visible in FIG. 2) disposed at opposite sides of the middle washware rack 300. FIG. 7 shows upper and lower rollers R mounted on one side wall 303 of the middle washware rack 300 and which are configured to roll on the telescopic rail assembly TR. The rollers R are provided on both sides 303 of the middle washware rack 300. As will be discussed in more detail below, each stemware support/cup shelf assembly 10A and 10B comprises a shelf-shaped part that clips rotatably to a side wall of a washware rack such as, for example, the side wall 303 of the middle washware rack 300. Each stemware support/cup shelf assembly 10A and 10B may be formed of a plastic material such as, but not limited to, mineral filled polypropylene.

With reference to FIG. 2, one of the adjustable tine rows 306' is rotated down in a non-use position, while the other tine row 306 is rotated upward in a use position. The shelf-shaped part of the stemware support/cup shelf assembly 10 comprises a frame F having a front edge portion 20 with a plurality of notches N which support stemware, an upper shelf portion 22 which serves as a cup shelf CS, and a rear edge portion 24 having a pair of mounts 30 and 32 for rotatably mounting the stemware support/cup shelf assembly 10 to the side wall portion 303 of the middle washware rack 300.

Figure 4B:
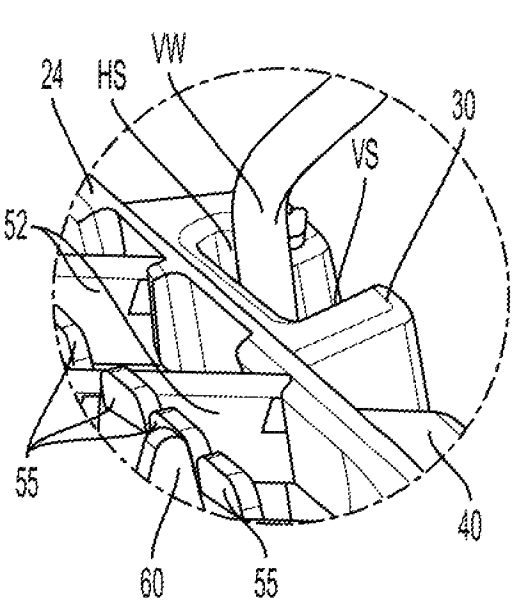
FIGS. 4A and 4B are a perspective view and an enlarged view, respectively, of the stemware support/cup shelf assembly shown rotated into its final working angle according to an exemplary embodiment consistent with the present disclosure.
Figure 4A:
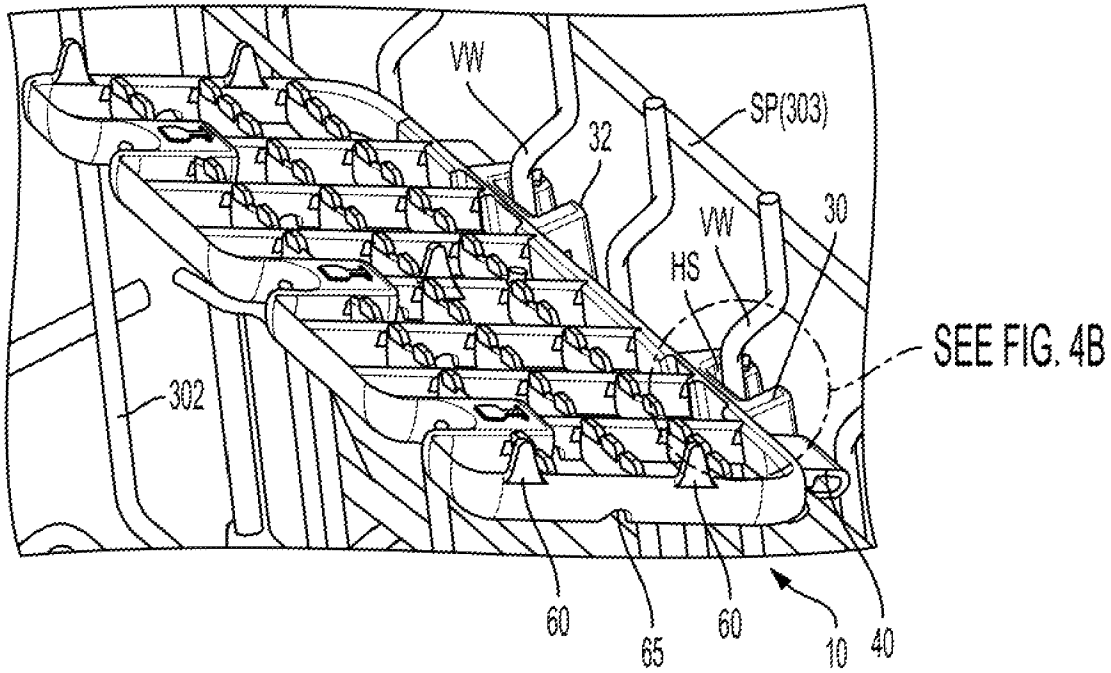
Figure 4C:
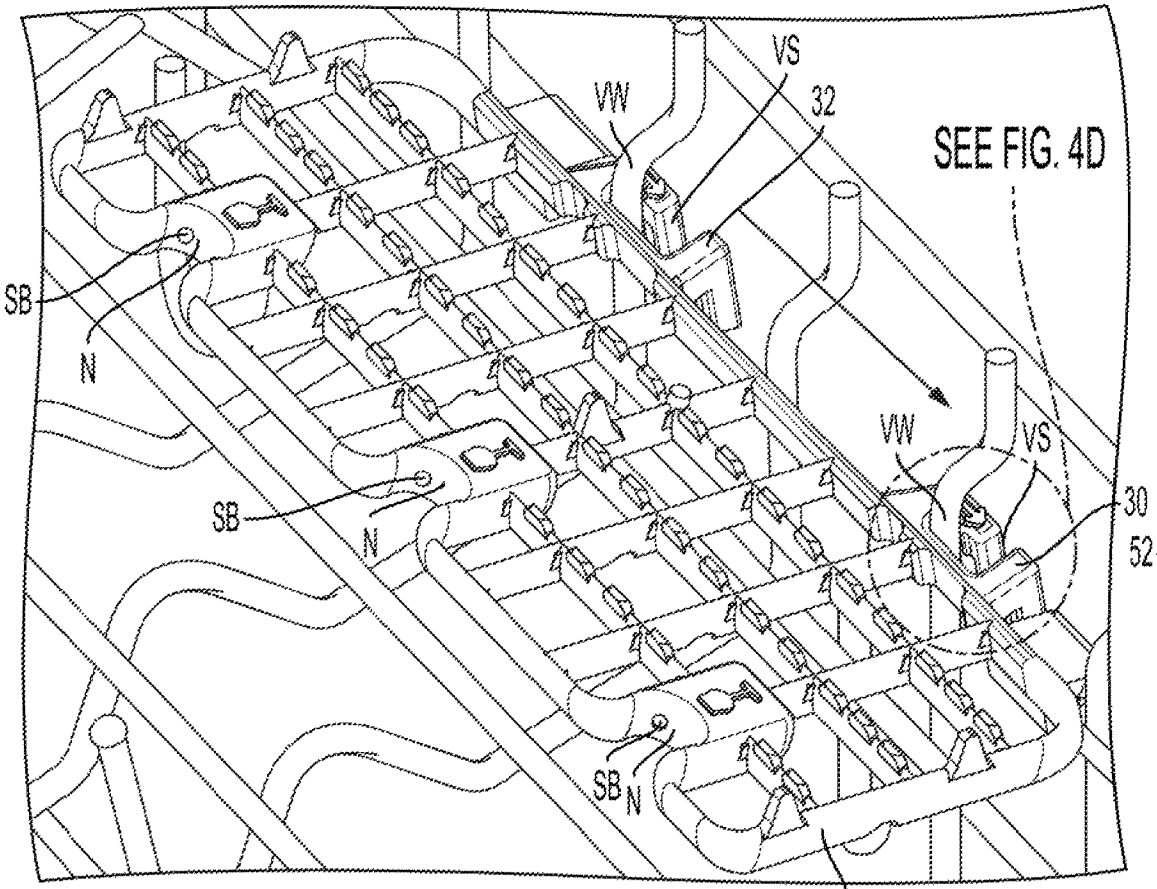
FIGS. 4C and 4D are a perspective view and an enlarged view, respectively, of the stemware support/cup shelf assembly shown sliding and locking into its final working position according to an exemplary embodiment consistent with the present disclosure.

The plurality of notches N support stemware such as, but not limited to, the stemmed wine glasses WG. In this case, while three notches N are shown in each of the stemware support/cup shelf assemblies 10, clearly more or less notches N can be used. Also, while four stemmed wine glasses WG are shown in FIG. 2, six smaller stemware such as, for example, champagne flutes could be supported at one time by the six notches N. As best seen in FIGS. 2 and 4C, each notch N can include a pair of support bumps SB to aid in supporting the stem portion of stemware such as a stemmed wine glass WG.

Figure 3A:
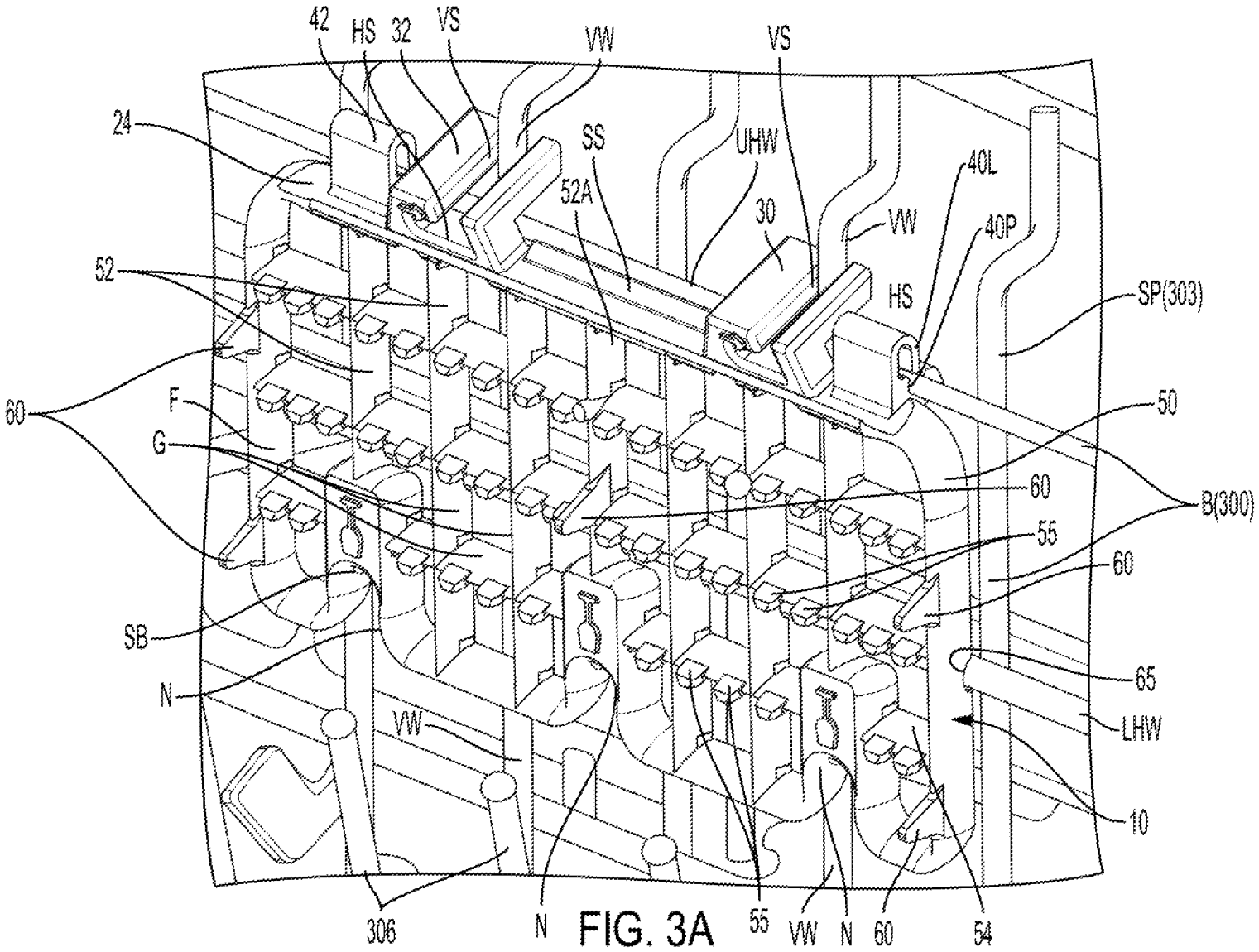
FIG. 3A is a perspective view of the stemware support/cup shelf assembly shown in a stowed position according to an exemplary embodiment consistent with the present disclosure.
Figure 3C:
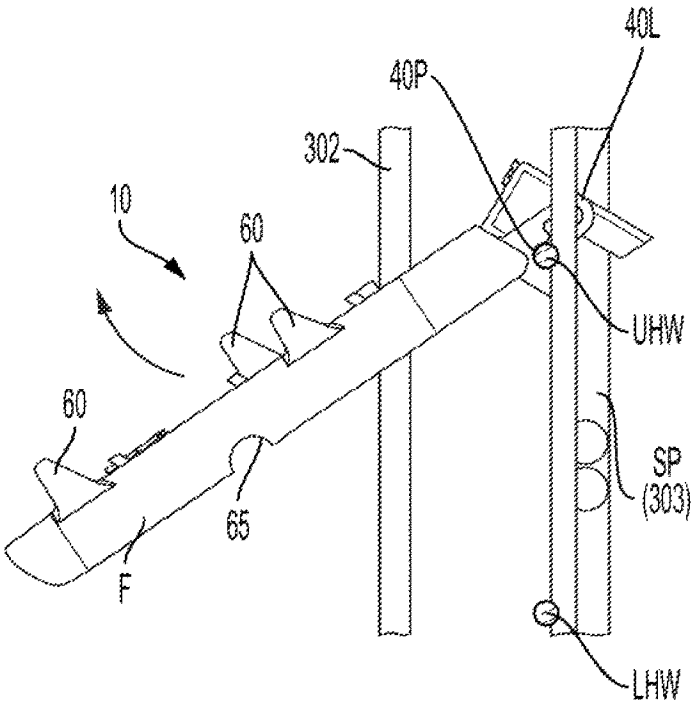
FIGS. 3B and 3C are a perspective view and a side/partial sectional view, respectively, of the stemware support/cup shelf assembly shown rotating upward into a working position according to an exemplary embodiment consistent with the present disclosure.
Figure 3B:
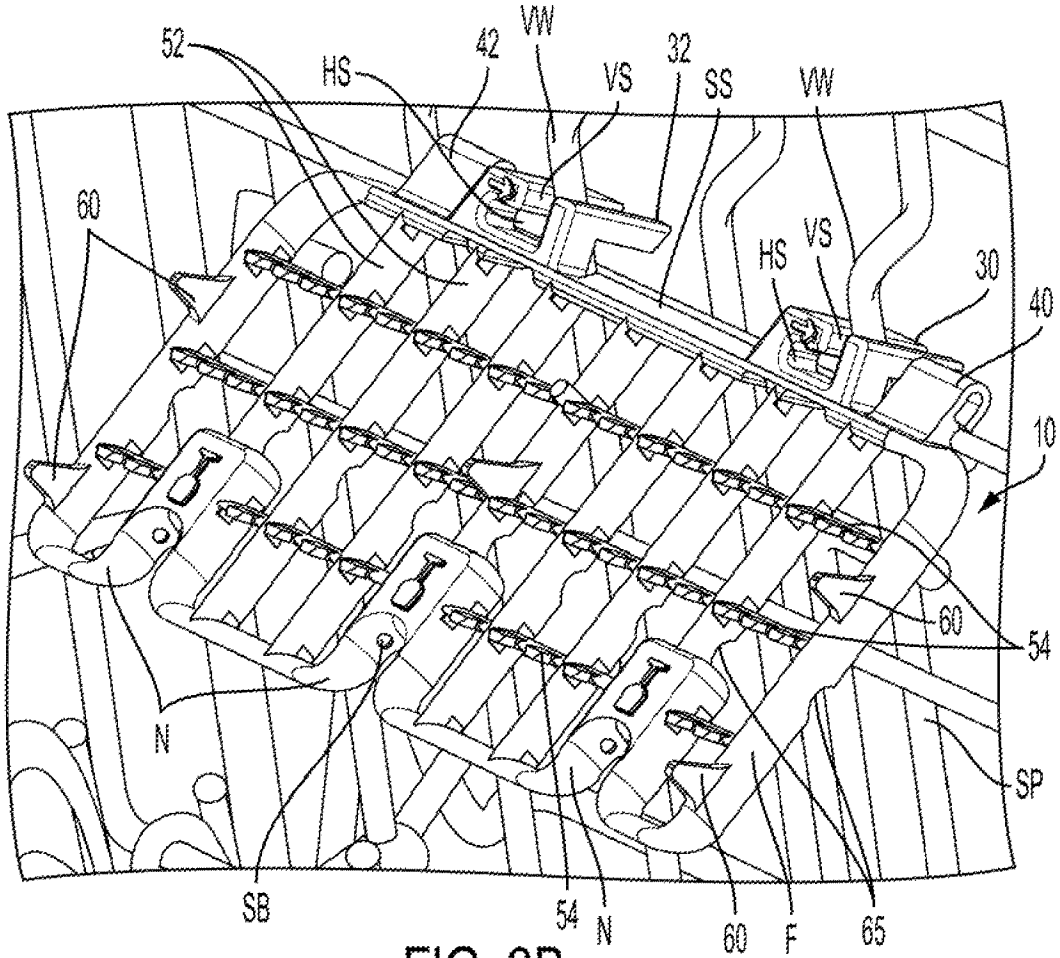

FIGS. 3A-3C are various views of the stemware support/cup shelf assembly 10 according to an exemplary embodiment consistent with the present disclosure. In particular, FIG. 3A shows one stemware support/cup shelf assembly 10 rotated downward into the stowed position along the side wall portion identified generally as SP (corresponding to side wall 303) of the washware rack 300 which is configured as a basket B. The rear edge portion 24 of the frame F also includes a pair of hinges 40 and 42 on which the frame F is supported when in the stowed position along the side wall portion SP of the basket B which forms the washware rack 300 and which allow the frame F to rotate about an upper horizontal wire UHW of the side wall portion SP. Each of the pair of mounts 30 and 32 is configured to allow the frame F to rotate upward (see FIGS. 3B and 3C) from the stowed position (see FIG. 3A) into a working angle position of approximately 25 degrees upward from a horizontal position (see FIGS. 4A, 4B, 6, and 7) and then slide horizontally into a final locked position (see FIGS. 4C and 4D). A structural support portion SS may also be included along the lower edge of the rear edge portion 24 between the two mounts 30 and 32 (see especially FIGS. 3C and 5-7). The structural support portion SS is an elongated, horizontal extension from the rear edge portion 24 that includes a recess or rounded groove 25 into which the upper horizontal wire UHW of the side wall portion SP of the basket B is inserted and serves to support the frame F against the upper horizontal wire UHW when cups, for example, are loaded on the cup shelf CS.

The hinges 40 and 42 allow the frame F to rotate or pivot about the upper horizontal wire UHW as the stemware support/cup shelf assembly 10 is rotated between the use or working position and the non-use or stowed position. In this regard, note that each hinge 40 and 42 includes a recessed portion 40P near its base (one of which is visible in FIG. 3A) into which the upper horizontal wire UHW fits and which allows the frame F to rotate or pivot about the upper horizontal wire UHW, and a hinge lock 40L. In this regard, note that the hinge locks 40L flex away when the stemware support/cup shelf assembly 10 is installed on the upper horizontal wire UHW of the washware rack 300 and then snap back into place, so that the hinges 40 and 42 are locked to the upper horizontal wire UHW.

Figure 4D:
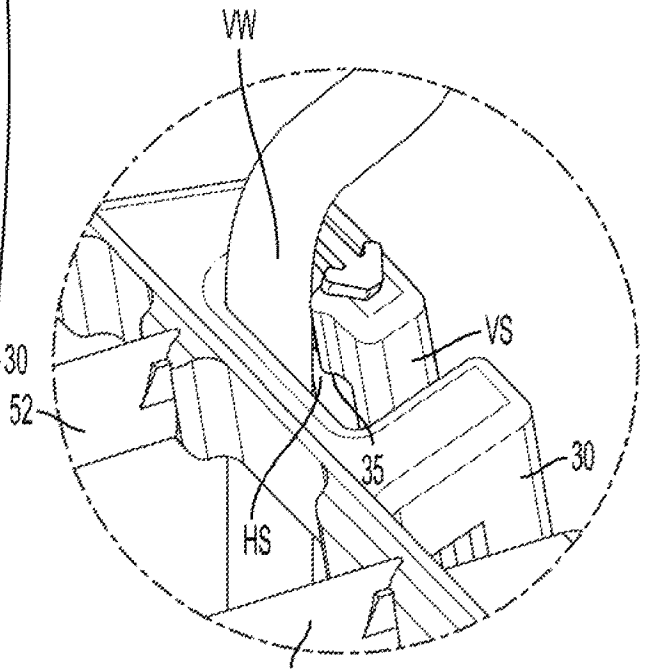
Figure 5:
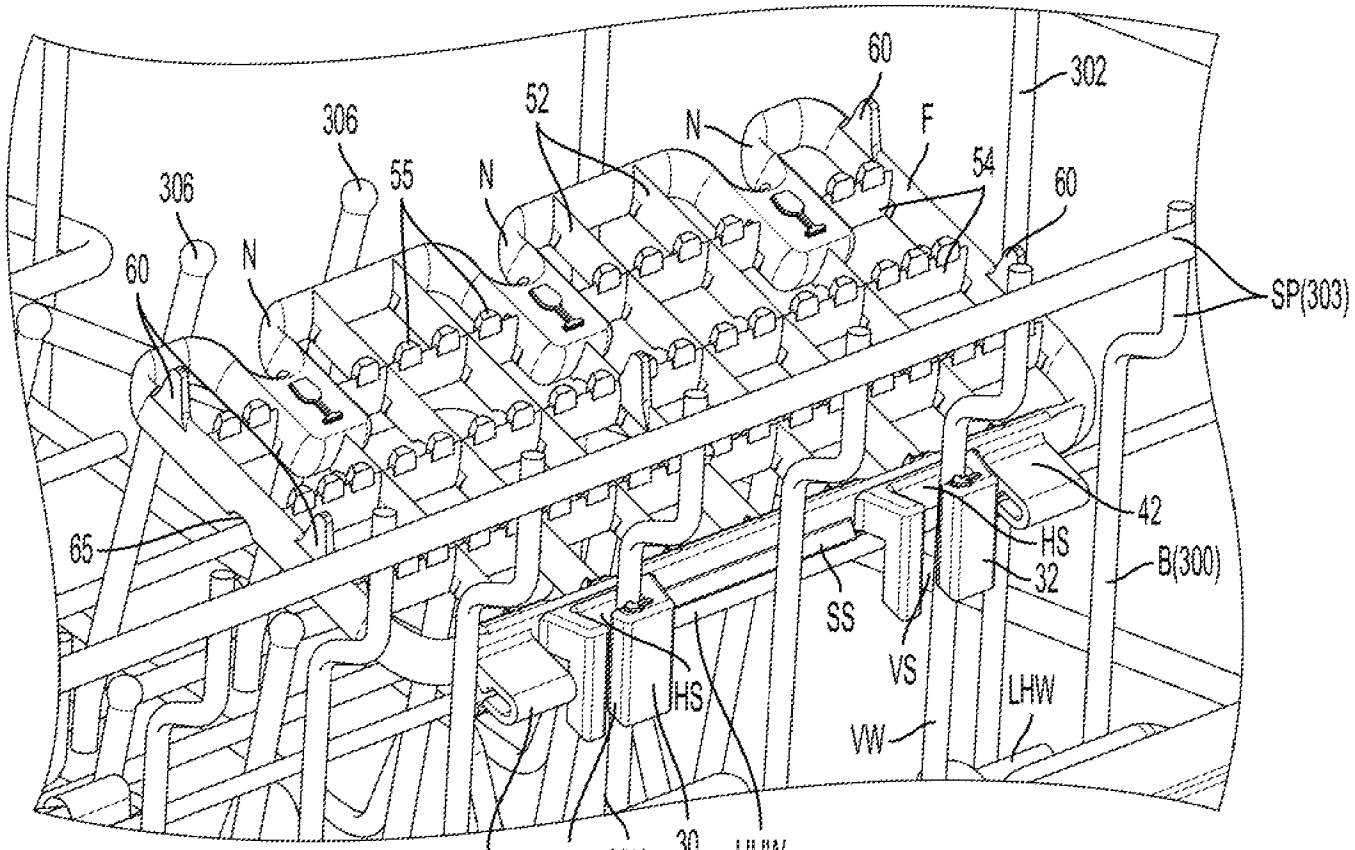
FIG. 5 is a rear perspective view of the stemware support/cup shelf assembly shown in its final, locked working position on the washware rack according to an exemplary embodiment consistent with the present disclosure.
Figure 6:
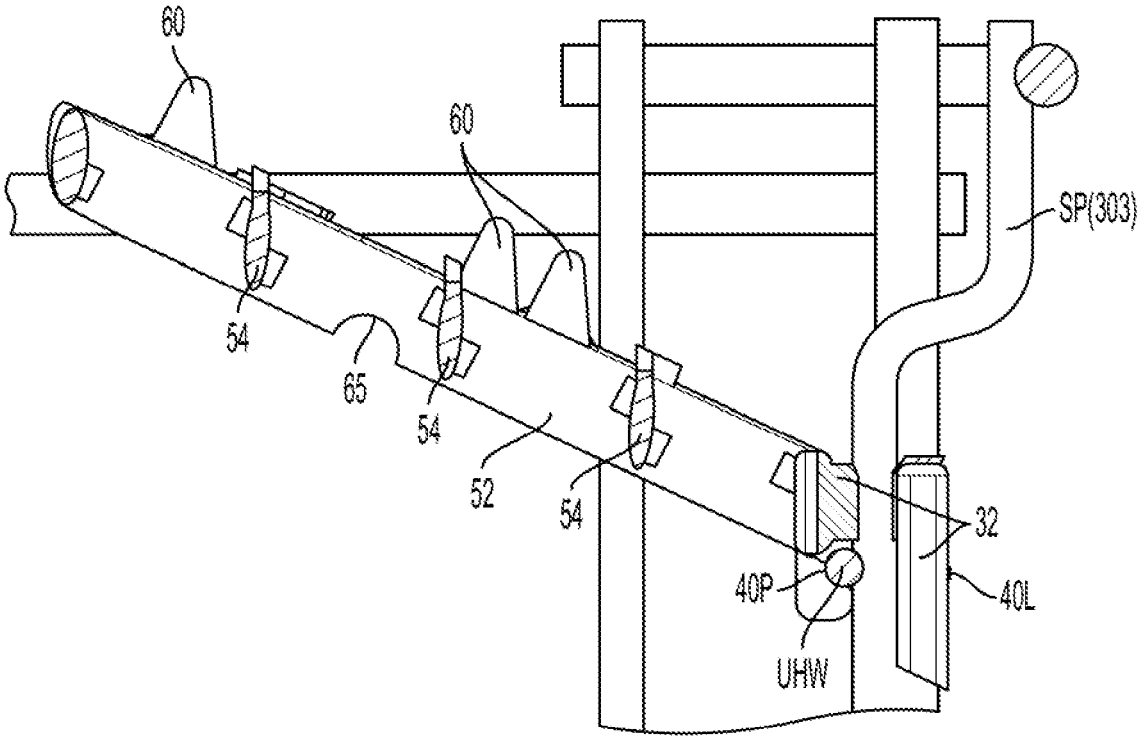
FIG. 6 is a sectional view through the stemware support/cup shelf assembly (including at locations of a rear mount 32 and a rear hinge 42) and a side wall of the washware rack according to an exemplary embodiment consistent with the present disclosure.

As best shown in FIGS. 3A, 4A-4D, and 5, each of the pair of mounts 30 and 32 comprises a vertical slot VS and a horizontal slot HS which interact with a corresponding vertical wire VW of the side wall portion SP of the basket B which forms the washware rack 300. The horizontal slot HS includes a retaining nub 35 which clicks past the corresponding vertical wire VW of the side wall portion SP of the basket B on condition that the frame F of the stemware support/cup shelf assembly 10 is slid into the final locked position, as shown in FIG. 4D.

As best shown in FIGS. 3A, 4A, 5 and 6, the frame F is configured as a shelf-shaped part having a generally rectangular outer rim 50 and a set of spaced apart ribs 52 extending from front to back of the frame F and another set of ribs 54 extending from side-to-side of the frame F, so that the ribs 52 and 54 are perpendicular to each other and form a grate-shaped structure G which allows water to drain therethrough. The ribs 54 extending from side-to-side of the frame F have small projections 55 extending upwardly therefrom. Additional larger projections 60 extend from the side edges of the outer rim 50 and also from a center rib 52A. The small projections 55 and larger projections 60 serve as retaining members to retain cups that are placed on the grate-shaped structure G of the cup shelf CS. FIG. 8 shows one of the stemware support/cup shelf assemblies 10 being used as a cup shelf CS with two cups, e.g., a small cup SC and a large cup LC, shown on the cup shelf CS.

As best shown in FIGS. 3A, 3B, 3C, and 6, the bottom of the outer rim 50 of the frame F as well as the bottom of the ribs 52 can include rounded cutouts 65 (note that only one cutout is visible in FIGS. 3A and 3C) which are configured to fit over a lower horizontal wire LHW when the frame F is in a stowed position along the side wall portion SP of the basket B (see FIG. 3A).

FIG. 9 is a fragmentary perspective view of a washware rack 300 in the form of a basket B with a pair of the stemware support/cup shelf assemblies 10, with the rear stemware support/cup shelf assembly 10A supporting a stemmed wine glass WG and a large cup LC and the front stemware support/cup shelf assembly 10B being shown in a stowed position along the side wall portion SP of the basket B.

When in operation, in order to change one of the stemware support/cup shelf assemblies 10 from a stowed position (shown in FIG. 3A) to a final locked position for use (shown in FIGS. 4D, and 5-8), the user grabs ahold of the frame F such as at the outer rim 50 and begins to rotate the front edge portion 20 of the frame F away from the side wall portion SP and continues to rotate the frame F upward about the recessed portions 40P of the hinges 40 and 42 and also about the structural support portion SS on the upper horizontal wire UHW while at the same time the vertical slots VS allow the vertical wires VW of the side portion SP of the basket B to move therethrough (see FIGS. 3B and 3C). The user continues to rotate the frame F upward until the upper shelf portion 22 of the frame F is at the final working angle of about 25 degrees up from horizontal (see FIGS. 4A and 4B). Then, the user slides the frame F horizontally or sideways (in this case, forward toward the front of the basket B) such that the horizontal slot HS slides with respect to the vertical wire VW of the side wall portion SP of the basket B until the retaining nub 35 clicks past the vertical wire VW (see FIGS. 4C and 4D), such that the frame F of the stemware support/cup shelf assembly 10 is slid into the final locked position (see FIGS. 4D, and 5-8). The user can now support wine glasses WG by resting the cup portions (also referred to as the liquid retaining portions) of the wine glasses WG on bottom portion (e.g., the bottom portion 304) of the basket B and by resting the stems of the wine glasses WG in the notches N, such that the cup portions of the wine glasses WG are pointed toward the dishwasher water spray jets from the spray arm S1 (see FIGS. 1, 2, and 7), or support large cups LC and/or small cups SC or other small dishes or items (see FIG. 8) on the cup shelf CS, or support both a wine glass WG in one of the notches N and a cup such as a large cup LC on the cup shelf CS (see FIG. 9).

To again place the stemware support/cup shelf assembly 10 in the stowed position along the side wall portion SP of the basket B, the user simply reverses the above steps by pushing the frame F horizontally in an opposite direction or toward the back of the basket B such that the retaining nubs 35 move past and free up the vertical wires VW, and the frame F continues to move with respect to the vertical wires VW along the horizontal slots HS until the vertical slots VS are in alignment with the vertical wires VW. Then, the user can rotate the frame F down about the hinges 40 and 42 that are rotatably clipped on the upper horizontal wire UHW while the vertical slots VS allow the vertical wires VW to move therethrough until the frame F is positioned along the side wall portion SP of the basket B and the rounded cutouts 65 fit over the lower horizontal wire LHW. The frame F is supported by the hinges 40 and 42 in the stowed position (see FIG. 3A).

Accordingly, consistent with the present disclosure, each of the stemware support/cup shelf assemblies 10 has two functions: 1) to support the stems of one or more wine glasses or similar stemware type glasses, while at the same time holding the stemware in a position so that the cup portion of the glass is pointed toward the dishwasher water spray jets to permit effective cleaning of the glass; and 2) to provide a flat shelf area where cups and other small dishes and items can be arranged for washing.

The present invention has substantial opportunity for variation without departing from the spirit or scope of the present invention. For example, while the middle washware rack 300 is provided with stemware support/cup shelf assemblies 10, other washware racks, such as the lower washware rack or upper washware rack can also be configured to accommodate stemware support/cup shelf assemblies 10 consistent with the present disclosure. Also, the various features described in connection with a particular embodiment can be used (mixed and matched) with the other embodiments wherever appropriate.

Those skilled in the art will recognize improvements and modifications to the exemplary embodiments of the present invention. All such improvements and modifications are considered within the scope of the concepts disclosed herein and the claims that follow.

What is claimed is:

1. A stemware support/cup shelf assembly adapted to be disposed on a washware rack for supporting stemware and adapted to also serve as a cup shelf, comprising:

a frame having a front edge portion with a plurality of notches adapted to support stemware, an upper shelf portion adapted to serve as a cup shelf, and a rear edge portion having a pair of mounts for mounting the stemware support/cup shelf assembly to a side wall portion of the washware rack, wherein each of the pair of mounts comprises a vertical slot and a horizontal slot adapted to interact with a corresponding vertical wire of the side wall portion of the washware rack, with the vertical slot and the horizontal slot being in direct communication with each other, and wherein each of the pair of mounts is configured to allow the frame to rotate upward from a stowed position into a working angle position and then slide horizontally into a final locked position.

2. The stemware support/cup shelf assembly of claim 1, wherein the horizontal slot includes a retaining nub adapted to click past the corresponding vertical wire of the side wall portion of the washware rack as the frame of the stemware support/cup shelf assembly is slid into the final locked position.

3. The stemware support/cup shelf assembly of claim 1, wherein the frame comprises hinges adapted to allow the frame to rotate downward into the stowed position along the side wall portion of the washware rack.

4. The stemware support/cup shelf assembly of claim 3, wherein the frame is supported by the hinges when in the stowed position along the side wall portion of the washware rack.

5. The stemware support/cup shelf assembly of claim 1, further comprising hinges disposed along the rear edge portion next to the pair of mounts, the hinges adapted to allow the frame to rotate about a horizontal wire of the side wall portion of the washware rack.

6. A washware rack of a dishwasher, comprising:

a basket formed by a plurality of wire shaped elements, the plurality of wire shaped elements including a bottom portion and a side wall portion; and at least one stemware support/cup shelf assembly disposed on the side wall portion of the basket for supporting stemware and adapted to also serve as a cup shelf, the at least one stemware support/cup shelf assembly including a frame having a front edge portion with a plurality of notches adapted to support stemware, an upper shelf portion adapted to serve as a cup shelf, and a rear edge portion having a pair of mounts for mounting the at least one stemware support/cup shelf assembly to the side wall portion of the basket, wherein each of the pair of mounts comprises a vertical slot and a horizontal slot which interact with a corresponding vertical wire of the side wall portion of the basket, with the vertical slot and the horizontal slot being in direct communication with each other, and wherein each of the pair of mounts is configured to allow the frame to rotate upward from a stowed position into a working angle position and then slide into a final locked position.

7. The washware rack of claim 6, wherein the horizontal slot includes a retaining nub which clicks past the corresponding vertical wire of the side wall portion of the basket as the frame of the at least one stemware support/cup shelf assembly is slid into the final locked position.

8. The washware rack of claim 6, wherein the frame comprises hinges which allow the frame to rotate downward into the stowed position along the side wall portion of the basket.

9. The washware rack of claim 8, wherein the frame is supported by the hinges when in the stowed position along the side wall portion of the basket.

10. The washware rack of claim 6, further comprising another of the at least one stemware support/cup shelf assembly such that there is a pair of stemware support/cup shelf assemblies disposed on the side wall portion of the basket, with each one of the pair of stemware support/cup shelf assemblies having three notches adapted to support a like number of stemware.

11. The washware rack of claim 6, further comprising hinges disposed along the rear edge portion next to the pair of mounts, the hinges allowing the frame to rotate about a horizontal wire of the plurality of wire shaped elements of the side wall portion of the washware rack.

12. A dishwasher, comprising:

a dishwashing compartment having a loading opening;

a door configured to close the loading opening;

at least one washware rack configured as a basket formed by a plurality of wire shaped elements, the plurality of wire shaped elements including a bottom portion and a side wall portion and being configured for movement out of and into the dishwashing compartment; and at least one stemware support/cup shelf assembly disposed on the side wall portion of the basket for supporting stemware and adapted to also serve as a cup shelf, the at least one stemware support/cup shelf assembly including a frame having a front edge portion with a plurality of notches adapted to support stemware, an upper shelf portion adapted to serve as a cup shelf, and a rear edge portion having a pair of mounts for mounting the at least one stemware support/cup shelf assembly to the side wall portion of the basket, wherein each of the pair of mounts comprises a vertical slot and a horizontal slot which interact with a corresponding vertical wire of the side wall portion of the basket, with the vertical slot and the horizontal slot being in direct communication with each other, and wherein each of the pair of mounts is configured to allow the frame to rotate upward from a stowed position into a working angle position and then slide into a final locked position.

13. The dishwasher of claim 12, wherein the horizontal slot includes a retaining nub which clicks past the corresponding vertical wire of the side wall portion of the basket as the frame of the at least one stemware support/cup shelf assembly is slid into the final locked position.

14. The dishwasher of claim 12, wherein the frame comprises hinges which allow the frame to rotate downward into the stowed position along the side wall portion of the basket.

15. The dishwasher of claim 14, wherein the frame is supported by the hinges when in the stowed position along the side wall portion of the basket.

16. The dishwasher of claim 12, further comprising another of the at least one stemware support/cup shelf assembly such that there is a pair of stemware support/cup shelf assemblies disposed on the side wall portion of the basket, with each one of the pair of stemware support/cup shelf assemblies having three notches adapted to support a like number of stemware.

17. The dishwasher of claim 12, further comprising hinges disposed along the rear edge portion next to the pair of mounts, the hinges allowing the frame to rotate about a horizontal wire of the plurality of wire shaped elements of the side wall portion of the washware rack.

* * * * *